US006024301A

United States Patent [19]

Hurley et al.

[11] Patent Number: 6,024,301

[45] Date of Patent: Feb. 15, 2000

[54] LOW $NO_X$ LIQUID FUEL OIL ATOMIZER SPRAY PLATE AND FABRICATION METHOD THEREOF

[75] Inventors: John F. Hurley, Easton; John N. Dale, Stratford, both of Conn.

[73] Assignee: Combustion Components Associates, Inc., Monroe, Conn.

[21] Appl. No.: 09/173,640

[22] Filed: Oct. 16, 1998

[51] Int. Cl.[7] ..... B05B 1/34

[52] U.S. Cl. ..... 239/492; 239/463; 239/601

[58] Field of Search ..... 239/461, 463, 239/490–494, 601

[56] References Cited

U.S. PATENT DOCUMENTS

| | | | |
|---|---|---|---|
| 1,261,282 | 4/1918 | Peabody | 239/491 |
| 1,822,047 | 9/1931 | Leask | 239/492 |
| 2,037,645 | 4/1936 | Vroom et al. | 239/492 |
| 2,235,834 | 3/1941 | Gillette et al. | 239/491 |
| 2,665,946 | 1/1954 | Broughton | 239/601 X |
| 2,786,719 | 3/1957 | Kingsley | 239/463 X |
| 3,100,084 | 8/1963 | Biber | 239/492 |
| 4,087,050 | 5/1978 | Tsuji et al. | 239/490 |
| 4,218,020 | 8/1980 | Reider | 239/406 |
| 5,435,884 | 7/1995 | Simmons et al. | 216/100 |
| 5,611,299 | 3/1997 | Varga et al. | 122/498 |
| 5,622,489 | 4/1997 | Monro | 431/187 |
| 5,713,205 | 2/1998 | Sciocchetti et al. | 60/240 |
| 5,826,798 | 10/1998 | Schindler et al. | 239/403 |

*Primary Examiner*—Lesley D. Morris
*Attorney, Agent, or Firm*—Barry R. Lipsitz; Ralph F. Hoppin

[57] ABSTRACT

An atomizer spray plate is provided for discharging fuel oil. The spray plate has a cylindrical rear portion and a conical front portion. A frusto-conical whirl chamber extends from the rear portion to the front portion with a decreasing radius. The rear portion includes a number of whirl slots extending radially inward from an outboard region of the rear portion to the whirl chamber to provide the fuel oil with rotational energy. A discharge slot is provided in the front portion of the atomizer spray plate for receiving the fuel oil from the whirl chamber with the rotational energy. The discharge slot includes a cylindrical through-hole with a diameter d, and a transverse slot having a semi-circular cross-section with radius r. The discharge slot can be easily and economically fabricated with two shaping steps since there is no need to precisely set any particular non-right angle for walls of the discharge slot. Yet, the discharge slot provides a spray pattern with lateral fuel-rich zones separated by a central fuel-lean zone which inhibits the formation of $NO_x$ by reducing the peak combustion flame temperature generated by the spray pattern.

21 Claims, 4 Drawing Sheets

SLOT s
152
150
d
L
L
d
DRILL THRU

FUEL SPRAY
137
α°
130
132
136
141
105
r
150
152
b
134
248
c
136
135
238
133

130
2(c)
232
234
236
248
238
d
D2
150
246
D1
244
242
240
w
h
236
rw

LOW $NO_X$ LIQUID FUEL OIL ATOMIZER SPRAY PLATE AND FABRICATION METHOD THEREOF

BACKGROUND OF THE INVENTION

The present invention relates to an atomizer spray plate of a fuel oil atomizer for pressure-type atomization systems, including spill return systems, and simplex, or "once-through" systems.

For environmental and economical reasons, there is an ongoing need to improve the efficiency of fuel oil atomizers which supply fuel oil to a furnace. It is known that the formation of $NO_x$ can be slowed by providing fuel-rich and fuel-lean zones in the atomizing spray pattern. Such a fuel spray pattern can be achieved by imparting a rotational momentum, or swirl, to the fuel as it exits the atomizer, and by shaping the fuel spray in a specific manner.

For example, U.S. Pat. No 5,622,489 to Monro discloses a fuel atomizer with an oblong discharge slot that is shaped to achieve a spray pattern with fuel-rich zones that are spaced apart from one another and separated by a central fuel-lean zone. However, the shaping of the oblong slot is rather complex as the width and angle of the walls of the slot must be precisely set.

Accordingly, it would be desirable to provide a low $NO_x$ fuel oil atomizer with an atomizer spray plate that provides a spray pattern with fuel-rich and fuel-lean zones, yet does not require complex machining of the discharge slot. It would further be desirable to have a method for fabricating such an atomizer spray plate. Furthermore, the fuel oil atomizer should be compatible with pressure-type atomization systems, including spill return systems and simplex systems.

The present invention provides an apparatus and method having the above and other advantages.

SUMMARY OF THE INVENTION

The present invention relates to an atomizer spray plate of a fuel oil atomizer for pressure-type atomization systems, including spill return systems, and simplex, or "once-through" systems.

An atomizer spray plate for discharging fuel oil in accordance with the present invention includes a generally cylindrical rear portion and a generally conical front portion. A frusto-conical whirl chamber extends from the rear portion to the front portion with a decreasing radius. A central longitudinal axis extends through the whirl chamber. Preferably, the rear portion includes a number of whirl slots extending radially inward from an outboard region of the rear portion to the whirl chamber. The whirl slots receive fuel oil at the outboard region and supply the fuel oil to the whirl chamber with a rotational energy.

A discharge slot is provided in the front portion of the atomizer spray plate for receiving the fuel oil from the whirl chamber with the rotational energy.

In particular, the discharge slot includes a cylindrical through-hole with a diameter d. A central longitudinal axis of the through-hole is co-linear with the central longitudinal axis of the whirl chamber. That is, the through-hole is aligned with the whirl chamber.

The discharge slot also includes a transverse slot having a semi-circular cross-section with radius r. The transverse slot extends approximately perpendicular to the central longitudinal axis of the cylindrical through-hole.

Advantageously, the discharge slot can be easily and economically fabricated with two shaping steps.

Furthermore, there is no need to precisely set any particular non-right angle for walls of the discharge slot. Yet, the discharge slot provides a spray pattern with lateral fuel-rich zones separated by a central fuel-lean zone. This spray pattern has been demonstrated by testing to reduce the peak combustion flame temperature, thereby inhibiting the formation of harmful $NO_x$ combustion byproducts.

The front portion of the atomizer spray plate preferably has a generally conical front surface surrounding the discharge slot and sloping at a particular angle, such as 85 degrees, relative to the central longitudinal axis of the cylindrical through-hole.

Furthermore, the radius r is selected to be slightly greater than d/2. The transverse slot is provided at a depth in the front portion to form a desired spray angle $\alpha$ that is defined by a tangent line to the transverse slot at a forward-most point of the front portion of the spray plate.

Preferably, the depth of the transverse slot is approximately $r(1-\sin(\alpha/2))$, the desired spray angle $\alpha$ is approximately 20 to 30°, and $r=d/(2*\cos(\alpha/2))$.

A developed spray angle of approximately 70°–90° is achieved along a length-wise direction of the transverse slot.

Optionally, a portion of the fuel oil in the whirl chamber is returned to a fuel oil supply instead of being supplied to the discharge slot.

Preferably, a ratio "A"/($d*D_2$) is in a range from approximately 0.4 to approximately 0.6, "A" is a total flow area of the whirl slots, and $D_2$ is a diameter of the whirl chamber at a point where the fuel oil is supplied to the whirl chamber from the whirl slots.

Furthermore, a method is presented for fabricating an atomizer spray plate for discharging fuel oil. The method includes the steps of: providing an atomizer spray plate having a rear portion and a front portion, providing a whirl chamber extending from the rear portion to the front portion, where the whirl chamber has a central longitudinal axis extending therethrough, and providing a discharge slot in the front portion for receiving fuel oil from the whirl chamber.

The discharge slot is obtained by providing (a) a cylindrical through-hole with a diameter d having a central longitudinal axis that is co-linear with the central longitudinal axis of the whirl chamber, and (b) a transverse slot having a semi-circular cross-section with radius r, the transverse slot extending approximately perpendicular to the central longitudinal axis of the cylindrical through-hole.

The rear portion of the atomizer spray plate is provided with a plurality of whirl slots extending radially inward from an outboard region of the rear portion to the whirl chamber to receive fuel oil and provide it to the whirl chamber with a rotational energy. The fuel oil is then provided to the discharge slot via the whirl chamber.

BRIEF DESCRIPTION OF THE DRAWINGS

FIG. 1(*b*) is a front view of the atomizer of FIG. 1(*a*) in accordance with the present invention.

FIG. 2(*b*) is a side cross-sectional view of a whirl slot of the atomizer spray plate of FIG. 2(*a*) in accordance with the present invention.

FIG. 2(*c*) is a side cross-sectional view of the atomizer spray plate of FIG. 2(*a*) in accordance with the present invention.

FIG. 2(*d*) is a front view of a discharge slot of the atomizer spray plate of FIG. 2(*c*) in accordance with the present invention.

FIG. 2(*e*) illustrates example dimensions of an atomizer spray plate in accordance with the present invention.

DETAILED DESCRIPTION OF THE INVENTION

The present invention relates to an atomizer spray plate of a fuel oil atomizer for pressure-type atomization systems, including spill return systems, and simplex, or "once-through" systems.

Figure 1B:
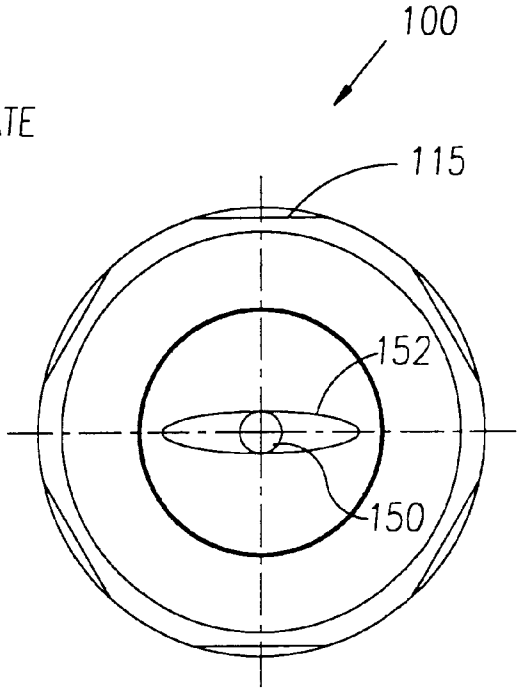
FIG. 1(*a*) is a side cross-sectional view of an atomizer in accordance with the present invention.
Figure 1A:
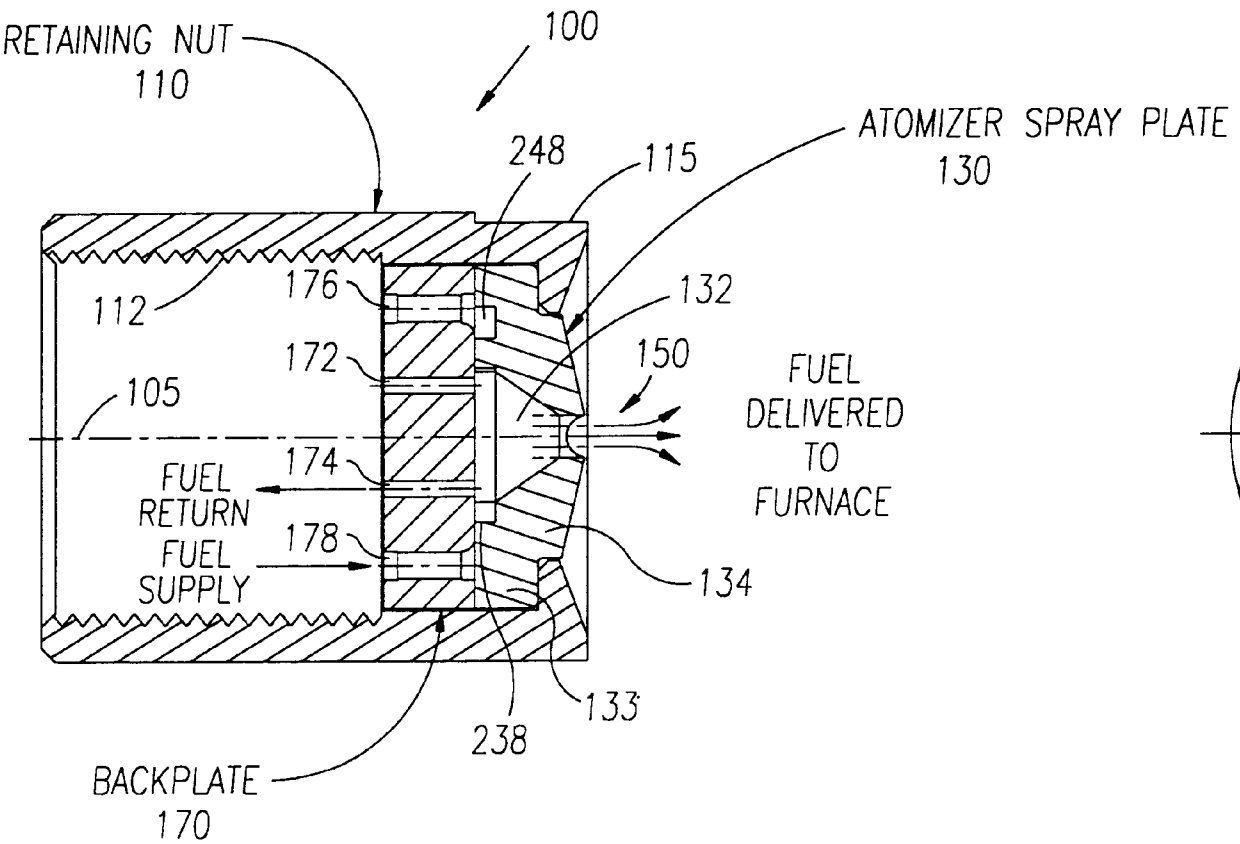

FIG. 1(*a*) is a side cross-sectional view of an atomizer in accordance with the present invention. The atomizer, shown generally at 100, includes a retaining nut 110, a backplate 170, and an atomizer spray plate 130. The retaining nut 110 is generally cylindrical, and includes an interior threaded portion 112 for fastening the retaining nut to an oil gun in a known manner. The backplate 170 fits within the retaining nut 110, and includes a number of circumferentially arranged fuel supply ports, e.g., including supply ports 176 and 178 shown in the cross-section, and a number of circumferentially arranged fuel return ports 172, e.g., including ports 172 and 174.

The atomizer spray plate 130 includes a cylindrical rear portion 133 and a generally conical front portion 134. The front portion 134 includes a discharge slot 150 in accordance with the present invention for delivering a fuel spray to a furnace. Furthermore, in the profile view of FIG. 1(*a*), a portion of whirl slots 238 and 248 are shown. The whirl slots are discussed in further detail in connection with FIG. 2(*a*), below.

In operation, pressurized fuel is supplied via the fuel supply ports, including ports 176 and 178. The fuel enters a number of whirl slots of the atomizer spray plate 130, including whirl slots 238 and 248, at the radially outboard location proximate to the ports 176 and 178. The fuel travels radially inward toward the longitudinal axis 105, through a frusto-conical whirl chamber 132, and through the discharge slot 150. A portion of the fuel in the whirl slots returns to the fuel supply via the fuel return ports, e.g. including ports 172 and 174.

FIG. 1(*b*) is a front view of the atomizer of FIG. 1(*a*) in accordance with the present invention. The cylindrical discharge slot 150 of the atomizer 100 may be created by drilling a cylindrical through-hole in the atomizer spray plate 130. A transverse slot 152 (e.g., transverse to the longitudinal axis 105) is provided in the atomizer spray plate 130 to shape the discharge slot 150 to provide the desired spray pattern with spaced apart fuel-rich zones and a central fuel-lean zone. A number of wrench contact surfaces, e.g., including surface 115, may be provided at the circumference of the retaining nut 110.

Figures 2A, 2B, 2C, 2D:
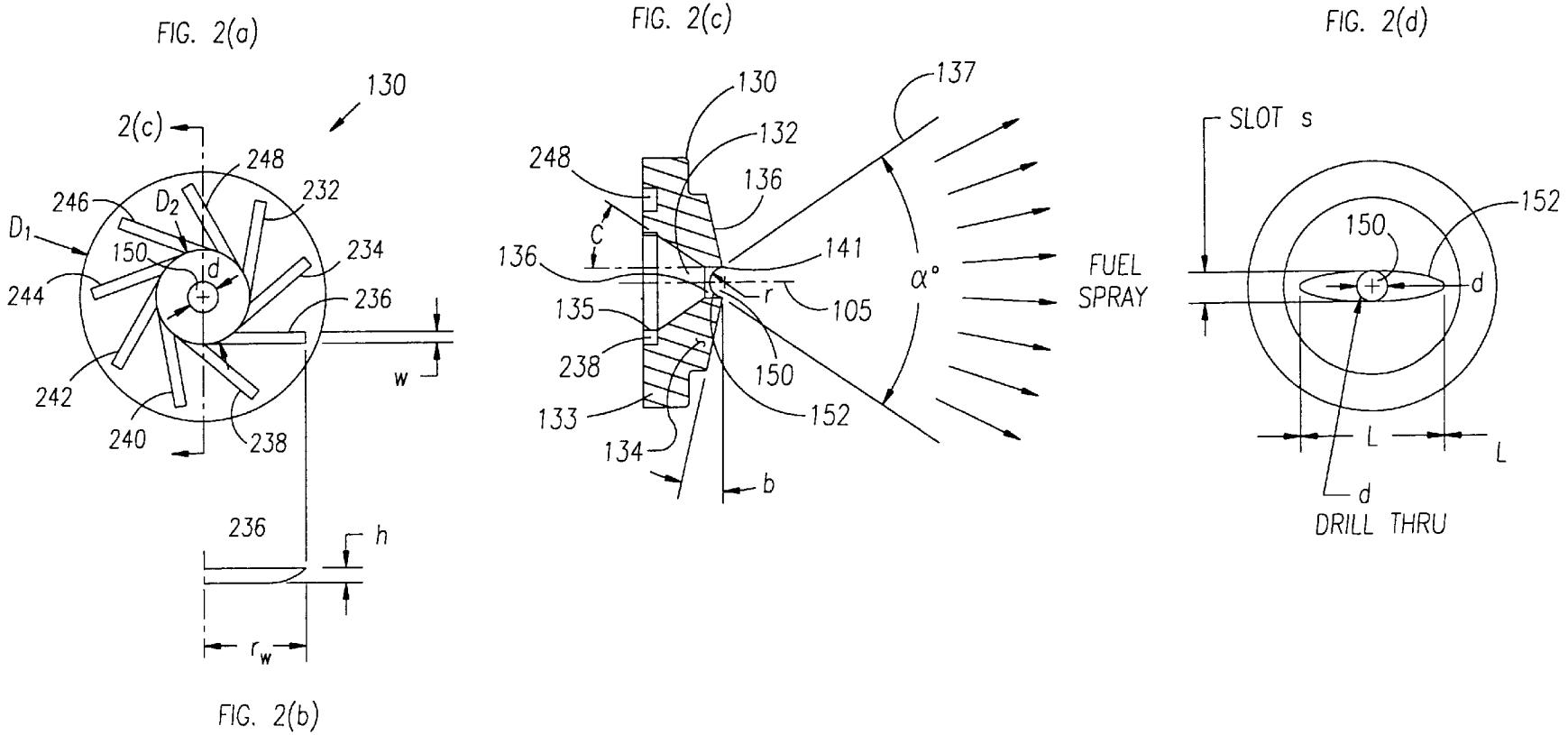
FIG. 2(*a*) is a front view of an atomizer spray plate in accordance with the present invention.
Figure 2E:
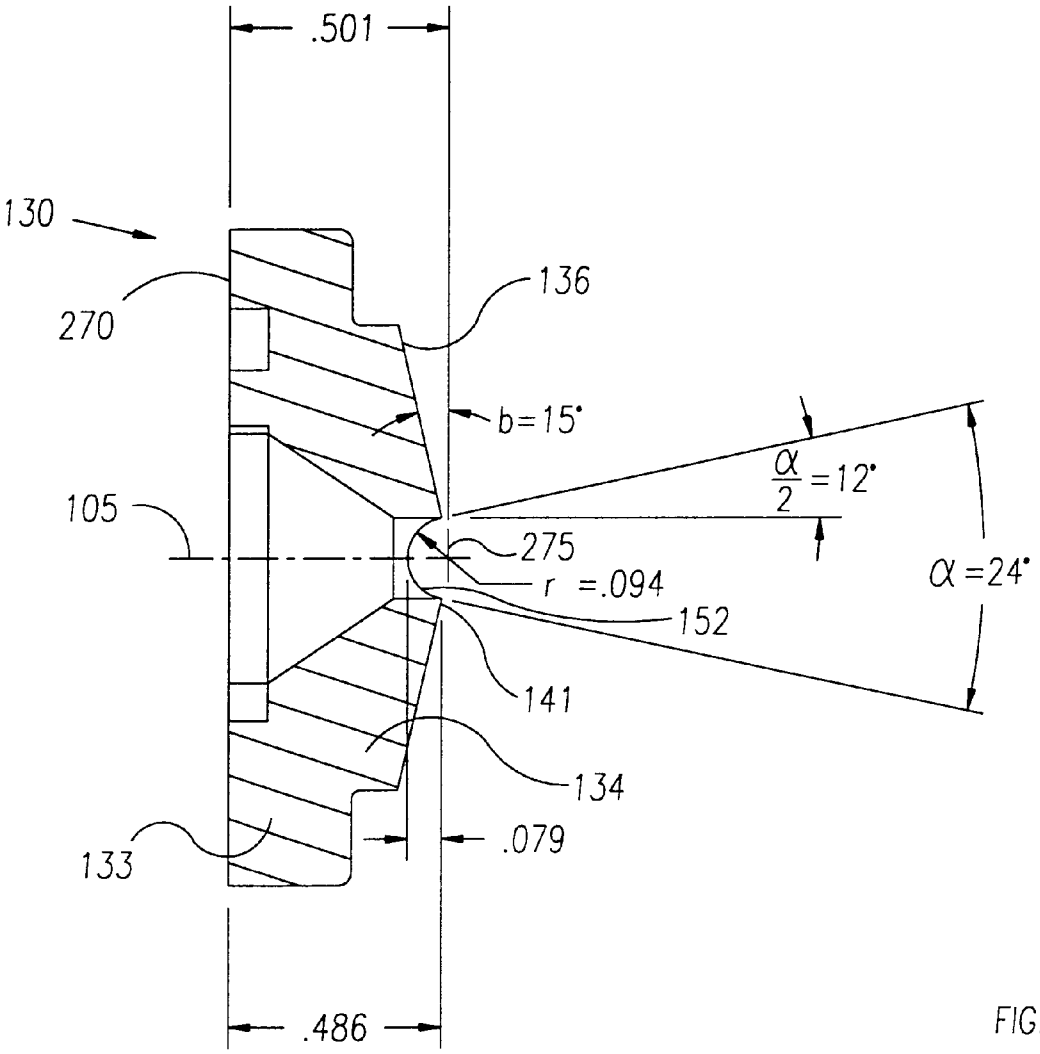

FIG. 2(*a*) is a front view of an atomizer spray plate in accordance with the present invention. The atomizer spray plate 130 has an outer diameter $D_1$, an inner whirl slot diameter $D_2$, and a discharge slot or hole diameter d. The diameter $D_2$ is the diameter of a base portion 135 of the whirl chamber 132 (see FIG. 2(*c*), while the discharge slot diameter d is the diameter of a tip portion of the whirl chamber 132.

The whirl slots 232, 234, 236, 238, 240, 242, 244, 246 and 248 are preferably arranged tangentially to the diameter $D_2$ of the base portion 135. Each whirl slot has a width w. The whirl slots may be cut into a smooth face of a cylindrical disk using a cutting wheel having a width w.

Preferably, approximately nine (9) whirl slots are provided, although the number may vary depending on the application. Nine whirl slots have been used successfully in a prototype atomizer spray plate tested by the present inventors.

FIG. 2(*b*) is a side cross-sectional view of a whirl slot of the atomizer spray plate of FIG. 2(*a*) in accordance with the present invention. Each whirl slot, e.g., such as whirl slot 236, has a height h and a radius $r_w$. The height refers to a distance in the direction of the longitudinal axis 105 of FIG. 1(*a*). The curvature at the whirl slot 236 along its radius is determined by the radius of the cutting wheel used to fabricate the slot.

Note that, for a given $D_1$, a larger diameter $D_2$ increases the energy imparted to the fuel by the whirl slots.

The height h of each whirl slot is preferably equal to 1.2 to 1.3 times the width w. Furthermore, the ratio of $A/(d*D_2)$ should be in the range of approximately 0.4 to 0.6, where A=N*w*h is the total flow area of the N whirl slots. For example, A=9*w*h when nine whirl slots are used. As mentioned, $D_2$ is the diameter of the base portion 135 of the frusto-conical whirl chamber 132, which acts as a spin chamber for the fuel oil received from the whirl slots.

FIG. 2(*c*) is a side cross-sectional view of the atomizer spray plate of FIG. 2(*a*) in accordance with the present invention. The whirl chamber 132 is frusto-conical in shape, and extends at an angle c of approximately 35° from the longitudinal axis 105. However, other angles may be used according to the specific application. The atomizer spray plate 130 includes a cylindrical base portion 133 and a conical front portion 134. A slot radius r of the semi-circular transverse slot 152, where r>d/2, is provided to achieve a fuel spray exit cone angle $\alpha$ of approximately 20°–30°. The transverse slot 152 is provided at a depth in the conical front portion 134 such that tangent lines 137 and 137' extend from the edges of the slot 152 at the desired angle. The tangent lines 137 and 137' are at an angle of $\alpha/2$ with respect to the longitudinal axis 105. Note also that the front surface 136 of the atomizer spray plate 130 extends at an angle b of approximately 15° to a vertical line that is perpendicular to the longitudinal axis 105, or equivalently, at an angle of (90–b)° to the longitudinal axis 105.

With the atomizer spray plate 130 of the present invention, a developed spray angle of approximately 70–90° is achieved in the direction of the transverse slot 152, with lateral fuel-rich zones on either side and a central fuel-lean zone. In particular, the central fuel-lean zone burns at a faster rate than the lateral fuel-rich zones, thereby resulting in a lower peak flame temperature, and inhibiting the formation of NOx.

FIG. 2(*d*) is a front view of a discharge slot of the atomizer spray plate of FIG. 2(*c*) in accordance with the present invention. The discharge slot or hole 150 has a diameter d as shown. The transverse slot 152 has a semi-circular cross-section, and a height s=d, and extends essentially perpendicular to the longitudinal axis 105 of the discharge slot 150.

It can be determined using simple trigonometric relations that, to achieve the angle $\alpha$ between the tangent lines 137 and 137' of FIG. 2(*c*), the transverse slot radius r should be $r=d/(2*\cos(\alpha/2))$. For example, for $\alpha/2=12$, r=0.511*d, or just slightly greater than d/2. A drill bit or other cutting tool having the designated radius r should therefore be selected to fabricate the transverse slot. Moreover, the length L of the transverse slot 152 is $L=2r(\cos(\alpha/2)+(1-\sin(\alpha/2))/\tan(b))$. For example, with $\alpha/2=12°$ and $b=15°$, $L=7.8r$. Alternatively, the center point of the drill having a radius r may be provided at a height above the front surface 136 of $r*\sin(\alpha/2)$ after the through-hole of diameter d has been provided. Equivalently, the transverse slot may be provided at a depth below the forward-most point 141 of the front surface 136 of the conical front portion 134 (e.g., in the direction of the longitudinal axis 105) of $r(1-\sin(\alpha/2))$. For example, with $\alpha/2=12$, the depth is 0.79r.

The transverse slot may therefore be provided using known machining techniques in straightforward and economical manner. Only one cylindrical through-hole is required, and only one transverse cut is made for the slot. Moreover, further simplifying the fabrication process, the transverse cut is at a right angle to the longitudinal axis of the spray atomizer.

FIG. 2(*e*) illustrates example dimensions of an atomizer spray plate in accordance with the present invention. All linear dimensions are in inches. Moreover, while the dimensions shown have been proven successful in testing, the dimension may be scaled or otherwise altered as required for specific applications.

The transverse slot 152 has a radius r=0.094 inches, with an imaginary origin of the radius at a point 275. A circular cutting tool used to create the transverse slot may have a central longitudinal axis that passes through the point 275. In this example, $\alpha/2=12°$, and $b=15°$.

Here, using a coordinate system that is parallel to the longitudinal axis 105, the depth of the transverse slot relative to the forward-most point 141 of the front surface 136 of the conical front portion 134 of the atomizer spray plate 130 is 0.079 inches. A distance between the forward-most point 141 and a back surface 270 of the atomizer spray plate 130 is 0.486 inches. A distance between the imaginary origin 275 of r and the back surface 270 is 0.501 inches. A distance between the imaginary origin 275 of r and the forward-most point 141 is 0.501–0.486=0.015 inches.

Figure 3:
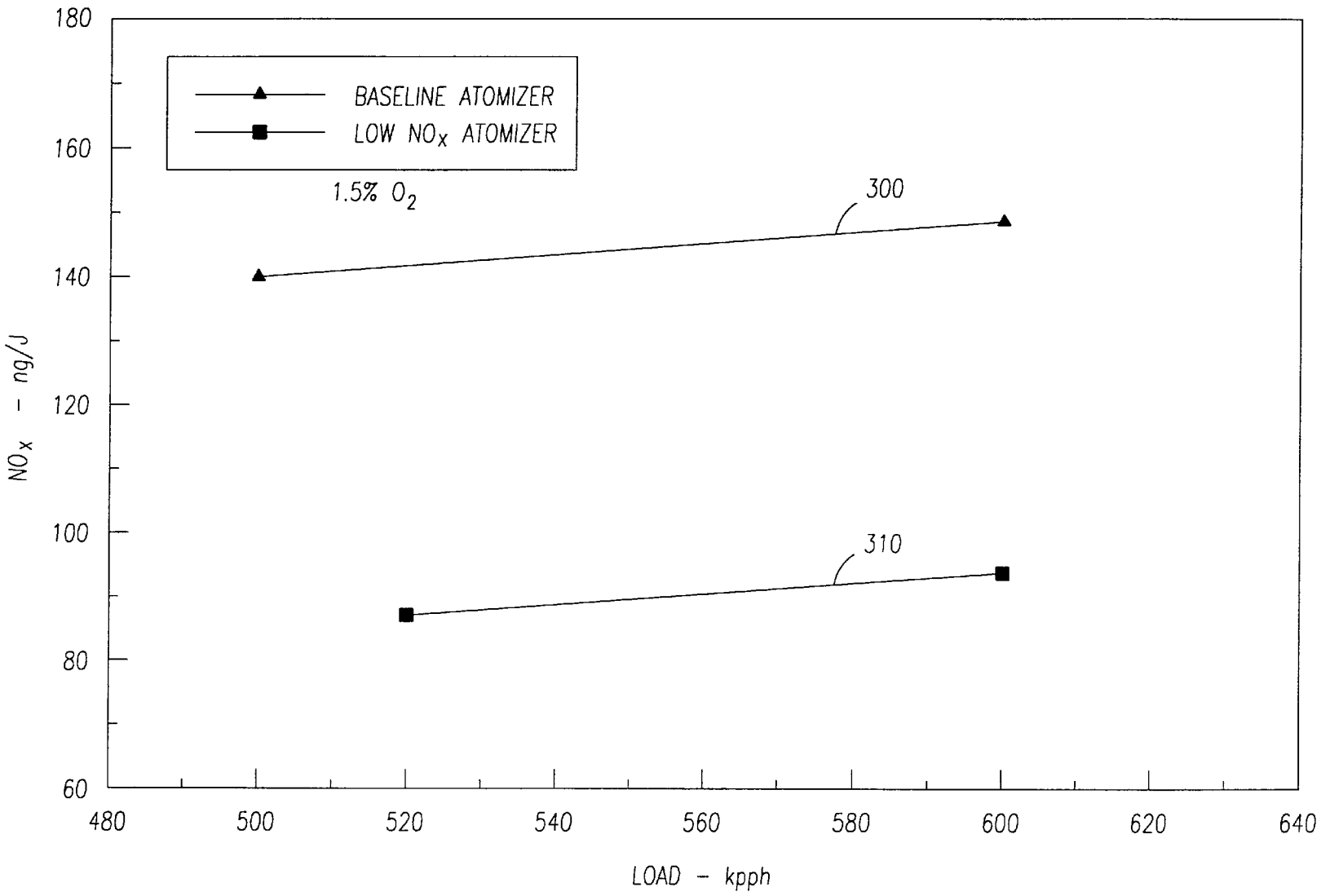
FIG. 3 is a graph demonstrating the performance of the atomizer of the present invention.

FIG. 3 is a graph demonstrating the performance of the atomizer of the present invention. Line 300 shows the level of $NO_x$ in nanograms per Joule for a baseline atomizer corresponding to an atomizer spray plate with a straight-through cylindrical discharge slot and a planar exit wall surrounding the discharge slot.

Line 310 shows the level of $NO_x$ for the low $NO_x$ atomizer using the atomizer spray plate with the discharge slot in accordance with the present invention. The level of $O_2$ for the test is 1.5%. In the horizontal axis, the load in thousands of pounds per hour of steam is indicated. As shown, the low $NO_x$ atomizer of the present invention was successful in significantly reducing the level of $NO_x$.

As seen, a fuel atomizer for pressure type atomization systems has been described. Fuel oil is supplied to an atomizer spray plate via passages in a backplate. The fuel oil passes through radial whirl slots in the atomizer spray plate and into a whirl chamber at a high velocity. Some of the fuel may be returned back to the fuel supply system while the remaining fuel is delivered to a furnace in a spray pattern with fuel-rich zones separated by a central fuel-lean zone. A large tangential velocity is imparted to the fuel oil by the whirl slots to enable the creation of small fuel droplets in the flow delivered to the furnace.

Moreover, a developed spray angle is set by a ratio of tangential momentum to axial momentum as the oil leaves the atomizer. The atomizer spray plate of the present invention has a number of whirl slots having a specific geometry, and is provided with a transverse slot using a unique machining treatment that in effect divides the delivered fuel oil into finely atomized sprays.

A developed spray angle of approximately 70°–90° is achieved along the length-wise direction of the slot, e.g., perpendicular to a longitudinal axis of the discharge slot of the atomizer. Advantageously, the atomizer can be easily fabricated using a minimal number of machining steps. First an atomizer spray plate having a conical front end is provided. A cylindrical through-hole is provided in the center of the atomizer spray plate using a drill bit with a diameter d to form part of the discharge slot of the atomizer. Next, a drill bit or other circular cutting tool having a radius r, where $r>d/2$, is used to provide a transverse slot in the front face of the atomizer spray plate perpendicular to the through-hole. The transverse slot is provided at a specific depth relative to the front face so that the fuel exits the discharge slot to form a fuel spray pattern at a specific spray angle $\alpha$. Equivalently, the length L of the transverse slot may be set as specified.

Furthermore, the present inventors have determined that the spray plate reduces NOx particularly when the spray plate is constructed such that a particular ratio "A"/($d*D_2$) is in a range from 0.4–0.6, where "A" is a total flow area of the whirl slots, and $D_2$ is a diameter of the whirl chamber.

Additionally, a particular ratio (h/w) of whirl slot depth h to width w of 1.2–1.3 may be used.

Although the invention has been described in connection with various specific embodiments, those skilled in the art will appreciate that numerous adaptations and modifications may be made thereto without departing from the spirit and scope of the invention as set forth in the claims.

What is claimed is:

1. An atomizer spray plate for discharging fuel oil, comprising:

a rear portion;

a front portion;

a whirl chamber extending from said rear portion to said front portion;

said whirl chamber having a central longitudinal axis extending therethrough;

said rear portion including a plurality of whirl slots extending radially inward from an outboard region of said rear portion to said whirl chamber;

said whirl slots adapted to receive fuel oil at said outboard region and supply the fuel oil to said whirl chamber; and a discharge slot provided in said front portion for receiving the fuel oil from said whirl chamber; wherein said discharge slot comprises:

(a) a cylindrical through-hole with a diameter d having a central longitudinal axis that is co-linear with said central longitudinal axis of said whirl chamber; and (b) a transverse slot having a semi-circular cross-section with radius r, said transverse slot extending approximately perpendicular to said central longitudinal axis of said cylindrical through-hole.

2. The atomizer spray plate of claim 1, wherein:

said front portion has a generally conical front surface surrounding said discharge slot and sloping at a particular angle relative to said central longitudinal axis of said cylindrical through-hole;

said radius r is selected to be greater than d/2; and said transverse slot is provided at a depth in said front portion to form a desired spray angle $\alpha$ that is defined by a tangent line to said transverse slot at a forward-most point of said front portion.

3. The atomizer spray plate of claim 2, wherein:

said depth is approximately $r(1-\sin(\alpha/2))$.

4. The atomizer spray plate of claim 2, wherein:

said desired spray angle $\alpha$ is approximately 20 to approximately 30 degrees.

5. The atomizer spray plate of claim 2, wherein:

said particular angle is approximately 85 degrees.

6. The atomizer spray plate of claim 2, wherein:

$r=d/(2*\cos(\alpha/2))$.

7. The atomizer spray plate of claim 1, wherein:

a developed spray angle of approximately 70°–90° is achieved along a length-wise direction of said transverse slot.

8. The atomizer spray plate of claim 1, wherein:

said whirl chamber is frusto-conical.

9. The atomizer spray plate of claim 1, wherein:

a portion of the fuel oil in said whirl chamber is returned to a fuel oil supply instead of being supplied to said discharge slot.

10. The atomizer spray plate of claim 1, wherein:

a ratio "A"/($d*D_2$) is in a range from approximately 0.4 to approximately 0.6;

"A" is a total flow area of said whirl slots; and $D_2$ is a diameter of said whirl chamber where the fuel oil is supplied to said whirl chamber from said whirl slots.

11. The atomizer spray plate of claim 1, wherein:

each of said whirl slots has a depth h in a direction parallel to said central longitudinal axis of said whirl chamber, and a width w in a direction perpendicular to said direction of said depth h; and h/w is in a range from approximately 1.2 to approximately 1.3.

12. A method for fabricating an atomizer spray plate for discharging fuel oil, comprising the steps of:

providing an atomizer spray plate having a rear portion and a front portion;

providing a whirl chamber extending from said rear portion to said front portion;

said whirl chamber having a central longitudinal axis extending therethrough; and providing a discharge slot in said front portion for receiving fuel oil from said whirl chamber by providing:

(a) a cylindrical through-hole with a diameter d, and having a central longitudinal axis that is co-linear with said central longitudinal axis of said whirl chamber; and (b) a transverse slot having a semi-circular cross-section with radius r, said transverse slot extending approximately perpendicular to said central longitudinal axis of said cylindrical through-hole.

13. The method of claim 12, comprising the further step of:

providing said rear portion with a plurality of whirl slots extending radially inward from an outboard region of said rear portion to said whirl chamber; wherein:

said whirl slots are adapted to receive fuel oil at said outboard region and supply the fuel oil to said whirl chamber.

14. The method of claim 12, wherein:

said front portion has a generally conical front surface surrounding said discharge slot and sloping at a particular angle relative to said central longitudinal axis of said cylindrical through-hole; and said radius r is selected to be greater than d/2; and said transverse slot is provided at a depth in said front portion to form a desired spray angle $\alpha$ that is defined by tangent lines to said transverse slot.

15. The method of claim 14, wherein:

said depth is approximately $r(1-\sin(\alpha/2))$.

16. The method of claim 14, wherein:

said desired spray angle $\alpha$ is approximately 20 to approximately 30 degrees.

17. The method of claim 14, wherein:

said particular angle is approximately 85 degrees.

18. The method of claim 14, wherein:

$r=d/(2*\cos(\alpha/2))$.

19. The method of claim 12, wherein:

said whirl chamber is frusto-conical.

20. The method of claim 12, wherein:

a ratio "A"/($d*D_2$) is in a range from approximately 0.4 to approximately 0.6;

"A" is a total flow area of said whirl slots; and $D_2$ is a diameter of said whirl chamber where the fuel oil is supplied to said whirl chamber from said whirl slots.

21. The method of claim 12, wherein:

each of said whirl slots has a depth h in a direction parallel to said central longitudinal axis of said whirl chamber, and a width w in a direction perpendicular to said direction of said depth h; and h/w is in a range from approximately 1.2 to approximately 1.3.

* * * * *